US005607362A

United States Patent [19]

Haber et al.

[11] Patent Number: 5,607,362

[45] Date of Patent: Mar. 4, 1997

[54] SHOCK ABSORBING GOLF CLUB

[75] Inventors: Terry M. Haber, El Toro; William H. Smedley, Lake Elsinore; Clark B. Foster, Laguna Niguel; Jenny Y. Jechart, San Juan Capistrano, all of Calif.

[73] Assignee: Habley Medical Technology Corporation, Lake Forest, Calif.

[21] Appl. No.: 538,715

[22] Filed: Oct. 3, 1995

[51] Int. Cl.[6] ..... A63B 69/36

[52] U.S. Cl. ..... 473/231; 473/318

[58] Field of Search ..... 273/80 R, 80 B, 273/77 R, 186.2, 186.1, 187.4, 193 R, 194 R, 187.5; 473/231, 318

[56] References Cited

U.S. PATENT DOCUMENTS

| | | | |
|---|---|---|---|
| 1,471,794 | 10/1923 | Leven | 273/186.2 |
| 2,986,937 | 6/1961 | Chapman | 273/186.2 |
| 4,671,508 | 6/1987 | Tetreault | 273/186.2 |
| 4,932,661 | 6/1990 | Choi | 273/186.2 |
| 5,405,139 | 4/1995 | Gagarin | 273/186.2 |

FOREIGN PATENT DOCUMENTS

| | | | |
|---|---|---|---|
| 437905 | 11/1935 | United Kingdom | 273/186.2 |
| 2095566 | 10/1982 | United Kingdom | 273/186.2 |
| 2103492 | 2/1983 | United Kingdom | 273/186.2 |

*Primary Examiner*—Sebastiano Passaniti
*Attorney, Agent, or Firm*—Hawes, Fischer & Dickinson

[57] ABSTRACT

A shock absorbing golf club is disclosed that is adapted to minimize the transfer of shock to the hands of the golfer and reduce possible damage to the shaft of the club as a consequence of the impact force that is typically generated should the golf club head inadvertently strike the ground in advance of the golfer's ball. The foregoing is accomplished by the shaft of the golf club sliding axially and reciprocally through the grip which surrounds the shaft. A compression spring is located within the grip to receive and dissipate the impact force that is transmitted from the club head to the shaft to cause the shaft to slide through the grip towards the spring.

17 Claims, 3 Drawing Sheets

SHOCK ABSORBING GOLF CLUB

BACKGROUND OF THE INVENTION

1. Field of the Invention

This invention relates to a shock absorbing golf club that is adapted to minimize the transfer of shock to the hands of the golfer and reduce possible damage to the shaft of the club as a consequence of the impact force generated by the golf club head inadvertently striking the ground or another hard surface in advance of the golfer's ball.

2. Background Art

It is not uncommon for golfers to purchase a set of expensive clubs to play the game of golf. A variety of clubs having wood and metal heads are available for play depending upon the distance between the golf ball and the hole and the surface on which the ball lies. It is also not uncommon for beginners or those having little experience to accidentally strike the ground or another hard surface with the head of their golf club. In most cases, the golfer strikes the ground during his downswing and in advance of hitting the ball. In a limited number of other cases, the ground is struck during a practice swing or out of frustration stemming from poor golf play.

When a golf ball is driven off a tee, the shaft of the driver is relatively long and the velocity imparted to the club head during the downswing is usually high. When a golf ball is to be hit with a wedge-shaped head, the ball often lies in deep sand or in high grass. In many cases, a strong shock force is transmitted from the head of the club to the hands of the golfer in response to any impact force generated should the head strike the ground or another hard surface instead of the golf ball. The shock force can be particularly uncomfortable when the golfer is playing in cold whether. Moreover, where the velocity of a club head approaching the ball is high, the shaft is susceptible to damage (i.e. bending, cracking, and the like) as a consequence of the head of the club moving into contact with a surface that will not easily yield to the incoming club head. The foregoing may result in an expensive golf club having to be taken out of service.

It would therefore be desirable to have available a golf club that is adapted to dissipate the impact force generated should the head of the club accidentally and prematurely strikes the ground or another hard surface to minimize the transfer of shock to the hands of the golfer and reduce the likelihood of damage to the shaft so as to avoid the possibility of the golf club having to be scrapped.

SUMMARY OF THE INVENTION

The anti-shock golf club of this invention includes a hollow shaft, a conventional club head located at one end of the shaft, and a grip located at the opposite end of the shaft. In accordance with the present improvement, the shaft is adapted to slide axially and reciprocally through the grip in response to an impact force generated by the club head striking the ground or another hard surface during play. The grip has a hollow upper grip and a hollow lower grip that are mated end-to-end one another at respective open ends to receive the shaft therethrough. The upper grip also has a closed end and a compression spring located therewithin and seated against the closed end. A plug is positioned within the upper grip between the compression spring and the shaft, whereby an axial and rearward pushing force applied to the shaft will be transmitted to the spring via the plug to cause the spring to undergo compression. A limit pin projects radially outward from the shaft to ride through a longitudinally extending slot formed in the upper grip. An annular stop surrounding the shaft slides along a relatively narrow neck of the upper grip located opposite the closed end thereof.

With the shock absorbing golf club at rest or being correctly used during play, the club is in a relaxed condition during which the compression spring is fully expanded. Moreover, the limit pin is located at one end of the slot through the upper grip and the annular stop is seated against a ledge which projects towards the stop from the neck of the upper grip to prevent the undesirable separation of the shaft from the grip during play. Should the head of the shock absorbing golf club strike the ground or another hard surface, an axial pushing force is applied to the shaft to cause the shaft to slide rearwardly through the grip. Accordingly, the spring is compressed to dissipate the impact force generated by the club head striking the ground. What is more, the limit pin travels completely through the slot formed in the upper grip to block the continued axial displacement of the shaft through the grip. Similarly, the annular stop is moved off and away from the ledge at the neck of the upper grip.

At the conclusion of the impact force generated by the golf club head striking the ground, the shock absorbing golf club returns to the relaxed condition during which the compression spring expands to cause the shaft to slide forwardly through the grip and the limit pin to ride through the slot in the grip. At the same time, the annular stop travels with the shaft to be once again seated against the ledge at the neck of the upper grip, whereby to automatically position the shaft relative to the grip in the relaxed condition to permit continued use of the club in the normal fashion.

DETAILED DESCRIPTION

Figure 1A:
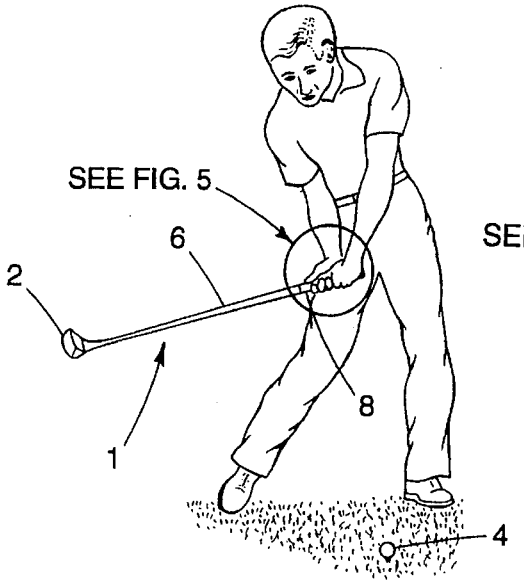
FIG. 1A shows a golfer swinging his golf club towards a golf ball during the downstroke of his golf swing.
Figure 1B:
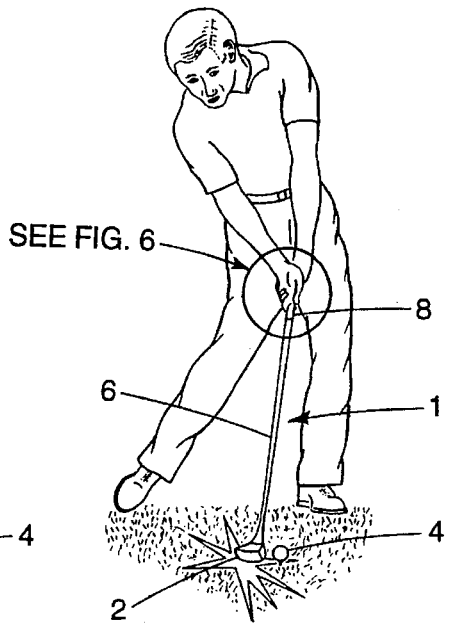
FIG. 1B shows the head of the golfer's club accidentally striking the ground ahead of the golf ball, whereby to generate an impact force.

The shock absorbing golf club 1 which forms the present invention is now described while referring initially to FIGS. 1A and 1B of the drawings. In FIG. 1A, a golfer is shown during the downstroke of his golf swing with the head 2 of his golf club 1 moving through the air at high velocity towards a golf ball 4. The golf club 1 with which the present invention is applicable may be selected by the golfer to either drive, pitch or chip the golf ball. Therefore, the head 2 of the golf club 1 can have a conventional design to be manufactured from wood, metal or any other suitable material.

In FIG. 1B, the golfer is shown during the downstroke of his golf swing with the head 2 of the golf club 1 prematurely and unintentionally striking the ground ahead of the golf ball 4. In one case, the impact force produced as the head 2 strikes the ground could damage the golf club 1. For example, the shaft 6 of golf club 1 might be bent or cracked, depending on the surface upon which the ball is resting and the speed of the golfer's swing. In other cases, the shock of the impact force would be transmitted from the club head 2 to the golfer's hands surrounding the grip 8, thereby subjecting the golfer to discomfort, depending upon the magnitude of the impact force and the ambient temperature during play.

Figure 2:
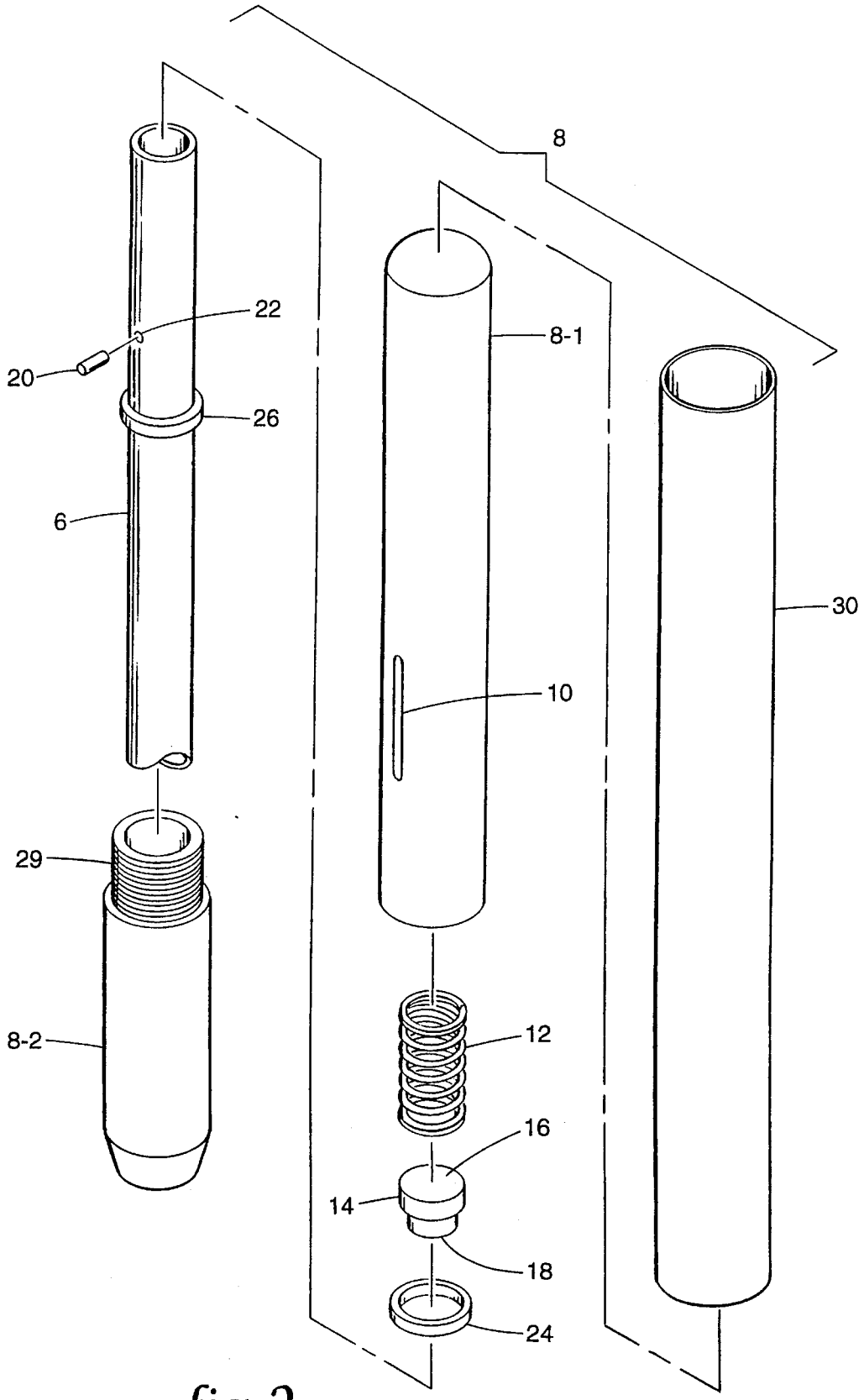
FIG. 2 is an exploded view of the grip of the shock absorbing golf club of the present invention.

Referring now to FIG. 2 of the drawings, the details are disclosed by which the shock absorbing golf club 1 of this invention is able to dissipate the impact force generated in the event that the club head 2 accidentally strikes the ground ahead of the ball 4, whereby to minimize any damage to the shaft 6 and reduce the shock transmitted to the hands of the golfer. To accomplish the foregoing, and as an important aspect of the present invention, the shaft 6 of the shock absorbing golf club 1 is adapted to slide axially and reciprocally through the grip 8.

Figure 3:
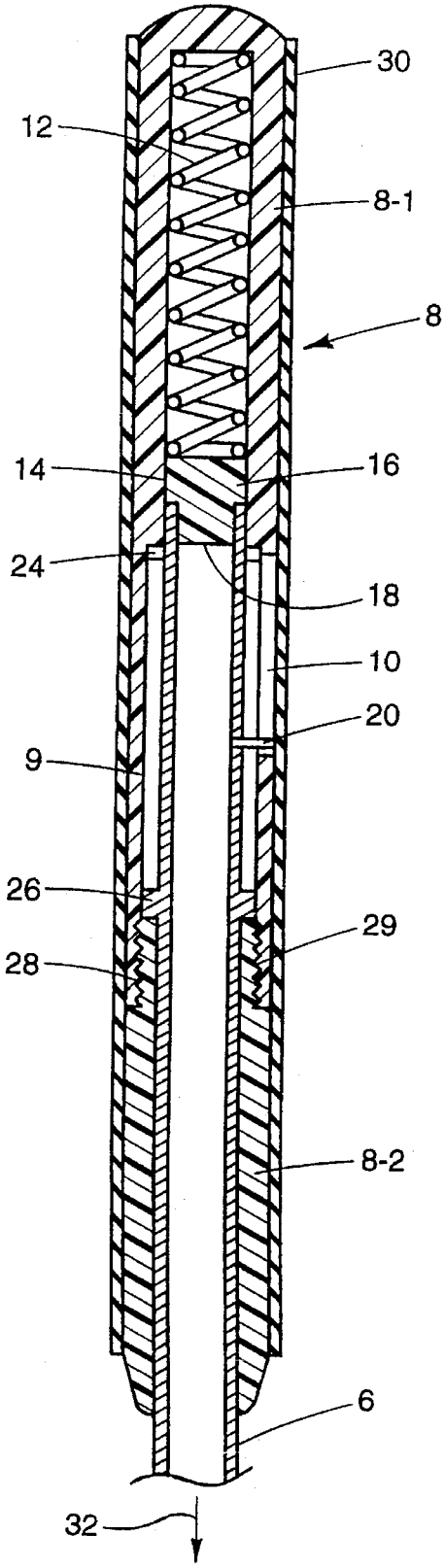
FIG. 3 is a cross-section of the grip of the shock absorbing golf club in the relaxed condition.
Figure 4:
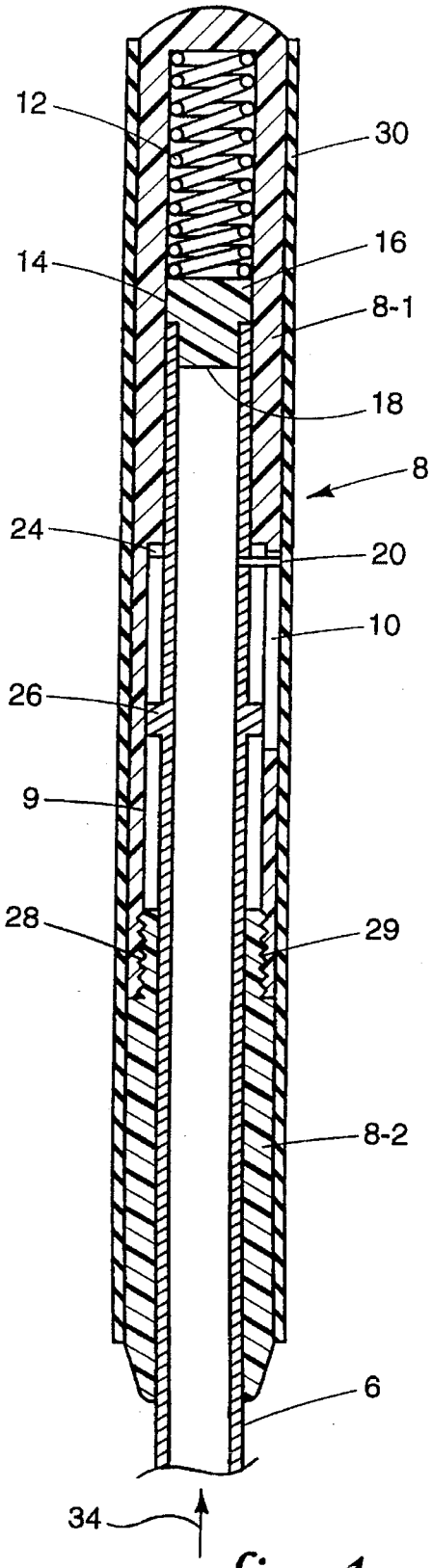
FIG. 4 is a cross-section of the grip of the shock absorbing golf club in the impact condition.

The grip 8 includes an upper grip 8-1 and a lower grip 8-2 that are connected end-to-end one another. As is best shown in FIGS. 3 and 4, the upper grip 8-1 is a generally hollow, cylindrical member. One end of the upper grip 8-1 is closed, while the opposite end is open. A series of annular screw threads (shown in FIGS. 3 and 4 and represented by the reference numeral 28) extends around the interior of the open end of upper grip 8-1 so as to be mated to corresponding external screw threads 29 around an open end of the lower grip 8-2. A short slot 10 extends longitudinally through the upper grip 8-2.

A helically wound compression spring 12 is located within the upper grip 8-1 so as to be seated against the closed end thereof. A plug 14 is also located within the upper grip 8-1 adjacent the compression spring 12. The plug 14 has a relatively wide disc-like end 16 that rests against the first turn of the spring 12 so that an axial pushing force applied to the plug 14 will be transmitted to the spring 12, whereby to cause a compression of the spring. The plug 14 also has a relatively narrow disc-like end 18 that is sized to be received in and mated to one end of the elongated golf club shaft 6.

The shaft 6 of the shock absorbing golf club 1 of this invention is a hollow tubular member that extends from the upper grip 8-1 and through the lower grip 8-2 for attachment to the golf club head (designated 2 in FIGS. 1A and 1B). A metal limit pin 20 is affixed (e.g. spot welded) to the shaft 6 at a hole 22 formed therethrough. As will be described hereinafter, with the grip 8 in the assembled condition shown in FIGS. 3 and 4, the limit pin 20 is received in and adapted to ride through the slot 10 in the upper grip 8-1 whenever the head 2 of the golf club 1 strikes the ground to cause the shaft 6 to recoil against and compress the spring 12. To this end, a bumper ring 24 that is manufactured from a resilient (e.g. rubber) material is seated on a ledge established at the rear of a relatively narrow neck 9 formed opposite the closed end of the upper grip 8-1 to absorb the impact of the limit pin 20 thereagainst when the limit pin 20 travels completely through the slot 10. In this regard, the rear ends of the narrow neck 9 and slot 10 of upper grip 8-1 closely coincide with one another. An annular stop 26 is coextensively formed around the shaft 6 so as to automatically position the reciprocating shaft 6 relative to the grip 8 when the shock absorbing golf club 1 recovers from the impact condition of the FIGS. 4 and 6 to the at rest condition of FIGS. 3 and 5.

The lower grip 8-2 of the shock absorbing golf club 1 is a hollow, generally cylindrical member having open opposite ends to accommodate the shaft 6 therethrough. A series of annular screw threads 29 extends around the exterior of the lower grip 8-2 adjacent one of the open ends thereof. As is best shown in FIGS. 3 and 4, the interior screw threads 28 of upper grip 8-1 are rotated into mating engagement with the exterior screw threads 29 of the lower grip 8-2 to assemble the grip 8 around the shaft 6. A cushion (e.g. rubber) sleve 30 surrounds the upper and lower grips 8-1 and 8-2 to form a comfortable gripping surface as is common to most golf clubs.

Figure 5:
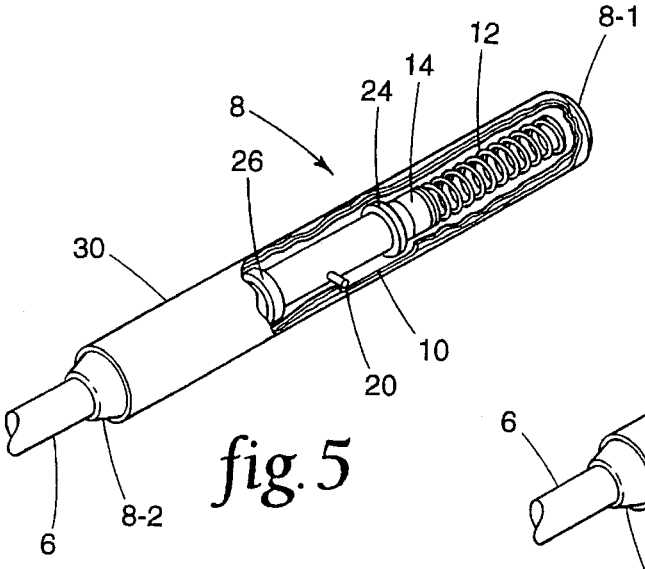
FIG. 5 is an enlarged detail taken from FIG. 1A.

The operation of the shock absorbing golf club 1 in relaxed and impact conditions and the sliding, reciprocal movement of the shaft 6 thereof along the grip 8 are now described while referring to FIGS. 3–6 of the drawings. In FIGS. 3 and 5, the shaft 6 and grip 8 are shown in the relaxed condition with the golf club 1 at rest or being used in a correct manner without striking the ground or any other hard surface during play. More particularly, in the relaxed condition, no compressive force is being applied to the compression spring 12, whereby the spring is also relaxed (i.e. fully expanded). The limit pin 20 extending from shaft 6 is located at the forward end of the slot 10 through upper grip 8-1. In this regard, with the limit pin 20 located at the forward end of the slot 10, the shaft 6 can not be thrown outwardly and free from the grip 8 when the golfer swings his club at a high rate of speed towards a golf ball (in the manner illustrated in FIG. 1A) and an axial throwing force is applied to shaft 6 in the direction of the reference arrow 32.

Similarly, in the relaxed condition shown in FIGS. 3 and 5, where the shaft 6 is stationary relative to the grip 8, the stop 26 surrounding shaft 6 is located at the forward end of the narrow neck 9 of upper grip 8-1 and against a ledge established by the threaded end of lower grip 8-2. The location of the annular stop 26 against the ledge of lower grip 8-2 serves as a redundant anti-separation feature with the limit pin 20 to prevent the shaft 6 from sliding forwardly through and separating from the grip 8 in response to the axial force 32 to which the shaft 6 will be subjected during the usual golf swing.

Figure 6:
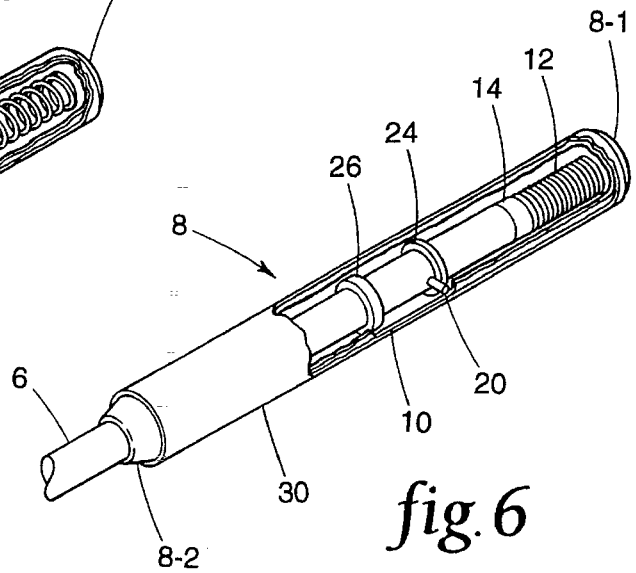
FIG. 6 is an enlarged detail taken from FIG. 1B.

Referring concurrently now to FIGS. 4 and 6 and to the impact condition, when the head 2 of the shock absorbing golf club 1 prematurely and inadvertently strikes the ground ahead of the golf ball 4 (in the manner illustrated in FIG. 1B), an axial pushing force is applied to the shaft 6 in the direction represented by the reference arrow 34. Accordingly, the shaft is caused to slide axially and rearwardly through the grip 8 in response to the axial force 34. More particularly, the plug 14 at the end of shaft 6 is moved towards the compression spring 12, whereby the cause the spring to compress and dissipate the impact force generated when the golf club head 2 strikes the ground.

As the shaft 6 continues to move rearwardly through the grip 8, the limit pin 20 affixed to the shaft 6 is correspondingly moved through the longitudinal slot 10 in the upper grip 8-1 until limit pin 20 engages the bumper ring 24 at the rear end of slot 10. The driving force of the limit pin 20 reaching the rear end of the slot 10 is absorbed by the bumper ring 24. Moreover, the further compression of the spring 12 and the continued rearward movement of the shaft 6 relative to the grip 8 is blocked by the limit pin 20 engaging the bumper ring 24 at the rear end of slot 10.

Similarly, in the impact condition shown in FIGS. 4 and 6, the annular stop 26 surrounding shaft 6 is moved rearwardly along the narrow neck 9 of upper grip 8-1. Both the limit pin 20 and the annular stop 26 are moved an identical distance with the shaft 6 relative to the grip 8 in response to the axial pushing force 34. In the present embodiment, the stop 26 is moved approximately midway along the narrow neck 9 of upper grip 8-1 before the limit pin 20 strikes the bumper ring 24 and blocks any further travel of the shaft 6.

At the conclusion of the impact force generated by the golf club head 2 striking the ground or another hard surface, the axial pushing force 34 applied to the shaft 6 is terminated. Therefore, the shock absorbing golf club 1 will return to the relaxed condition of FIGS. 3 and 5. That is, the energy stored by the compression spring 12 during the impact condition will cause spring 12 to expand. Accordingly, the shaft 6, which communicates with the spring 12 through the plug 14, will slide forwardly along the grip 8 so as to be ready for the next golf swing. In this regard, the annular stop 26 travels with the shaft 6 to be once again seated against the ledge at the threaded end of the lower grip 8-2 (best shown in FIG. 3) to automatically position the shaft 6 relative to the grip 8 in the relaxed condition and thereby permit continued use of the golf club 1 in the usual manner. However, by virtue of the shock absorbing golf club 1 of the present invention, the impact force generated by the club head 2 striking the ground will be absorbed and dissipated through the compression spring 12, whereby to minimize the shock transmitted to the hands of the golfer via the shaft and reduce the likelihood of damage to the shaft 6 which might necessitate that the club be scrapped.

It will be apparent that while the preferred embodiment of this invention has been shown and described, various modifications and changes may be made without departing from the true spirit and scope thereof.

Having thus set forth the preferred embodiment, what is claimed is:

1. A shock absorbing golf club comprising an elongated tubular shaft, a club head located at one end of the shaft and a hollow grip having a longitudinal axis located at the opposite end of the shaft, the shaft sliding inwardly and axially through the grip along the longitudinal axis thereof in response to an impact force that is generated by the club head striking the ground or another hard surface and transmitted to the shaft, and a compression spring positioned to receive thereagainst the impact force transmitted to the shaft, said compression spring undergoing a compression and thereby dissipating said force when the shaft slides inwardly through the grip.

2. The shock absorbing golf club recited in claim 1, wherein said compression spring is enclosed by the grip and located in axial alignment with the shaft, the shaft sliding towards said compression spring, such that the opposite end of the shaft causes said compression spring to be compressed in response to the impact force transmitted to the shaft.

3. The shock absorbing golf club recited in claim 1, further comprising means for interconnecting the opposite end of the shaft with said compression spring.

4. The shock absorbing golf club recited in claim 3, wherein said means for interconnecting the opposite end of the shaft with said compression spring includes a plug having first and second surfaces, the first of said surfaces of said plug communicating with the opposite end of the shaft and said second surface of said plug communicating with said compression spring, such that the impact force transmitted to the shaft is received by said compression spring via said plug.

5. The shock absorbing golf club recited in claim 1, further comprising a limit pin carried by and moving with the shaft as the shaft slides through the grip, and travel path means extending along the grip in the direction of the longitudinal axis thereof, said limit pin riding through said travel path means to control the shaft sliding through the grip in response to the impact force transmitted to the shaft.

6. The shock absorbing golf club recited in claim 5, wherein said travel path means is a slot formed in said grip, said limit pin received in and riding through said slot as the shaft slides through the grip.

7. The shock absorbing golf club recited in claim 6, further comprising a bumper located at one end of said slot to receive said limit pin thereagainst when said limit pin rides completely through said slot as the shaft slides through the grip, the receipt of said limit pin against said bumper blocking the continued sliding displacement of the shaft through the grip in response to the impact force transmitted to the shaft.

8. The shock absorbing golf club recited in claim 1, further comprising a stop projecting radially outward from said shaft and a ledge extending inward from said grip towards said stop, said stop seated upon said ledge to position the shaft relative to the grip in the absence of the impact force transmitted to the shaft.

9. The shock absorbing golf club recited in claim 1, wherein the grip includes upper and lower grip members aligned end-to-end one another to receive the opposite end of the shaft therethrough, each of said upper and lower grip members having first screw threaded ends to be mated together.

10. The shock absorbing golf club recited in claim 9, wherein said upper grip member has a closed end opposite said first screw threaded end thereof, said compression spring enclosed by said upper grip member and disposed against said closed end for receiving the impact force transmitted to the shaft when the opposite end of the shaft slides through said upper grip member towards said compression spring.

11. The shock absorbing golf club recited in claim 1, said compression spring undergoing an expansion to cause the shaft to slide axially and outwardly through the grip when the impact force applied to the club head and transmitted to the shaft has concluded.

12. A shock absorbing golf club comprising an elongated tubular shaft having a longitudinal axis, a club head located at one end of the shaft and a hollow grip located at the opposite end of the shaft, the shaft adapted to slide reciprocally through the hollow grip, and compression spring means for receiving the impact force transmitted to the shaft and dissipating said force when the shaft slides in a first direction through the grip to compress said compression spring means in response to an impact force generated by the club head striking the ground or other hard surface, said compression spring means expanding to cause the shaft to slide in an opposite direction through the grip when said impact force has concluded.

13. The shock absorbing golf club recited in claim 12, wherein said compression spring means is enclosed by the grip and arranged in axial alignment with the opposite end of the shaft along the longitudinal axis of the shaft.

14. The shock absorbing golf club recited in claim 12, further comprising means carried by and moving with the shaft to limit the movement of the shaft in said first direction through the grip in response to the impact force transmitted to the shaft.

15. The shock absorbing golf club recited in claim 14, wherein said means to limit the movement of the shaft in said first direction through the grip is a limit pin projecting radially outward from the shaft, said shock absorbing golf club further comprising a slot extending longitudinally along the grip, said limit pin riding through said slot in response to the impact force transmitted to the shaft.

16. The shock absorbing golf club recited in claim 15, further comprising a bumper located at one end of said slot to receive said limit pin thereagainst when said limit pin rides completely through said slot as the shaft slides through the grip in said first direction, the receipt of said limit pin against said bumper blocking the continued sliding displacement of the shaft through the grip in said first direction in response to the impact force transmitted to the shaft.

17. The shock absorbing golf club recited in claim 12, further comprising a stop projecting radially outward from said shaft and a ledge extending inward from said grip towards said stop, said stop seated upon said ledge to position the shaft relative to the grip in the absence of the impact force transmitted to the shaft.

* * * * *